US007322397B2

(12) United States Patent
Jacques et al.

(10) Patent No.: US 7,322,397 B2
(45) Date of Patent: Jan. 29, 2008

(54) CONTINUOUS CASTING OF REACTIONARY METALS USING A GLASS COVERING

(75) Inventors: Michael P. Jacques, Canton, OH (US); Frank P. Spadafora, Niles, OH (US); Kuang-O Yu, Highland Heights, OH (US); Brian W. Martin, N. Canton, OH (US)

(73) Assignee: RMI Titanium Company, Niles, OH (US)

( * ) Notice: Subject to any disclaimer, the term of this patent is extended or adjusted under 35 U.S.C. 154(b) by 0 days.

(21) Appl. No.: 10/989,563

(22) Filed: Nov. 16, 2004

(65) Prior Publication Data

US 2006/0102314 A1 May 18, 2006

(51) Int. Cl.
*B22D 11/10* (2006.01)

(52) U.S. Cl. ..... 164/439; 164/256; 164/338.1; 164/514; 164/268

(58) Field of Classification Search ..... 164/439, 164/488, 72, 258, 256, 338.1, 514, 469, 461, 164/268
See application file for complete search history.

(56) References Cited

U.S. PATENT DOCUMENTS 2,858,586 A * 11/1958 Brennan ..... 164/471
2,903,759 A * 9/1959 Brennan ..... 164/493
3,396,778 A 8/1968 Jensen et al.
3,470,939 A 10/1969 Coad
3,888,300 A 6/1975 Guichard et al.
4,024,309 A * 5/1977 Pender ..... 428/312.6
4,391,319 A 7/1983 Heaslip et al.
6,868,896 B2 * 3/2005 Jackson et al. ..... 164/514

* cited by examiner

*Primary Examiner*—Jonathan Johnson
*Assistant Examiner*—I.-H. Lin
(74) *Attorney, Agent, or Firm*—Sand & Sebolt

(57) ABSTRACT

A seal for a continuous casting furnace having a melting chamber with a mold therein for producing a metal cast includes a passage between the melting chamber and external atmosphere. As the cast moves through the passage, the cast outer surface and the passage inner surface define therebetween a reservoir for containing liquid glass or other molten material to prevent the external atmosphere from entering the melting chamber. Particulate material fed into the reservoir is melted by heat from the cast to form the molten material. The molten material coats the cast as it moves through the passage and solidifies to form a coating to protect the hot cast from reacting with the external atmosphere. Preferably, the mold has an inner surface with a cross-sectional shape to define a cross-sectional shape of the cast outer surface whereby these cross-sectional shapes are substantially the same as a cross-sectional shape of the passage inner surface.

5 Claims, 6 Drawing Sheets

CONTINUOUS CASTING OF REACTIONARY METALS USING A GLASS COVERING

BACKGROUND OF THE INVENTION

1. Technical Field

The invention relates generally to the continuous casting of metals. More particularly, the invention relates to the protection of reactionary metals from reacting with the atmosphere when molten or at elevated temperatures. Specifically, the invention relates to using a molten material such as liquid glass to form a barrier to prevent the atmosphere from entering the melting chamber of a continuous casting furnace and to coat a metal cast formed from such metals to protect the metal cast from the atmosphere.

2. Background Information

Hearth melting processes, Electron Beam Cold Hearth Refining (EBCHR) and Plasma Arc Cold Hearth Refining (PACHR), were originally developed to improve the quality of titanium alloys used for jet engine rotating components. Quality improvements in the field are primarily related to the removal of detrimental particles such as high density inclusions (HDI) and hard alpha particles. Recent applications for both EBCHR and PACHR are more focused on cost reduction considerations. Some ways to effect cost reduction are increasing the flexible use of various forms of input materials, creating a single-step melting process (conventional melting of titanium, for instance, requires two or three melting steps) and facilitating higher product yield.

Titanium and other metals are highly reactive and therefore must be melted in a vacuum or in an inert atmosphere. In electron beam cold hearth refining (EBCHR), a high vacuum is maintained in the furnace melting and casting chambers in order to allow the electron beam guns to operate. In plasma arc cold hearth refining (PACHR), the plasma arc torches use an inert gas such as helium or argon (typically helium) to produce plasma and therefore the atmosphere in the furnace consists primarily of a partial or positive pressure of the gas used by the plasma torches. In either case, contamination of the furnace chamber with oxygen or nitrogen, which react with molten titanium, may cause hard alpha defects in the cast titanium.

In order to permit extraction of the cast from the furnace with minimal interruption to the casting process and no contamination of the melting chamber with oxygen and nitrogen or other gases, current furnaces utilize a withdrawal chamber. During the casting process the lengthening cast moves out of the bottom of the mold through an isolation gate valve and into the withdrawal chamber. When the desired or maximum cast length is reached it is completely withdrawn out of the mold through the gate valve and into the withdrawal chamber. Then, the gate valve is closed to isolate the withdrawal chamber from the furnace melt chamber, the withdrawal chamber is moved from under the furnace and the cast is removed.

Although functional, such furnaces have several limitations. First, the maximum cast length is limited to the length of the withdrawal chamber. In addition, casting must be stopped during the process of removing a cast from the furnace. Thus, such furnaces allow continuous melting operations but do not allow continuous casting. Furthermore, the top of the cast will normally contain shrinkage cavities (pipe) that form when the cast cools. Controlled cooling of the cast top, known as a "hot top", can reduce these cavities, but the hot top is a time-consuming process which reduces productivity. The top portion of the cast containing shrinkage or pipe cavities is unusable material which thus leads to a yield loss. Moreover, there is an additional yield loss due to the dovetail at the bottom of the cast that attaches to the withdrawal ram.

The present invention eliminates or substantially reduces these problems with a sealing apparatus which permits continuous casting of the titanium, superalloys, refractory metals, and other reactive metals whereby the cast in the form of an ingot, bar, slab or the like can move from the interior of a continuous casting furnace to the exterior without allowing the introduction of air or other external atmosphere into the furnace chamber.

BRIEF SUMMARY OF THE INVENTION

The present invention provides a seal for a continuous casting furnace having an interior chamber, the seal comprising a heated metal cast; a passage communicating with the interior chamber and with atmosphere external to the interior chamber; the heated metal cast being movable through the passage from the interior chamber to the external atmosphere; and a barrier of molten material for preventing the external atmosphere from entering the interior chamber as the metal cast moves through the passage.

The present invention also provides an apparatus for use with a continuous casting furnace, the apparatus comprising means for melting a material to form molten material; means for moving a heated metal cast from within the furnace to atmosphere external to the furnace; said atmosphere being reactive with the heated metal cast; and means for applying the molten material to the heated metal cast to form a protective barrier thereon as the metal cast moves from the furnace to the external reactive atmosphere.

The present invention further provides a method comprising the steps of allowing molten material to coat a heated metal cast to form a protective barrier while within an atmosphere with which the heated metal cast is not reactive; moving the heated cast into an atmosphere with which the heated metal cast is reactive whereby the protective barrier protects the heated metal cast from reacting with the reactive atmosphere; and allowing the molten material to solidify on the heated metal cast.

The present invention further provides a method comprising the steps of moving a heated metal cast from within an interior chamber of a continuous casting furnace to the atmosphere external to the interior chamber via a passage bound by an inner periphery; and allowing molten material to form a barrier between the metal cast and the inner periphery of the passage to prevent the external atmosphere from entering the interior chamber.

DETAILED DESCRIPTION OF THE INVENTION

Figure 1:
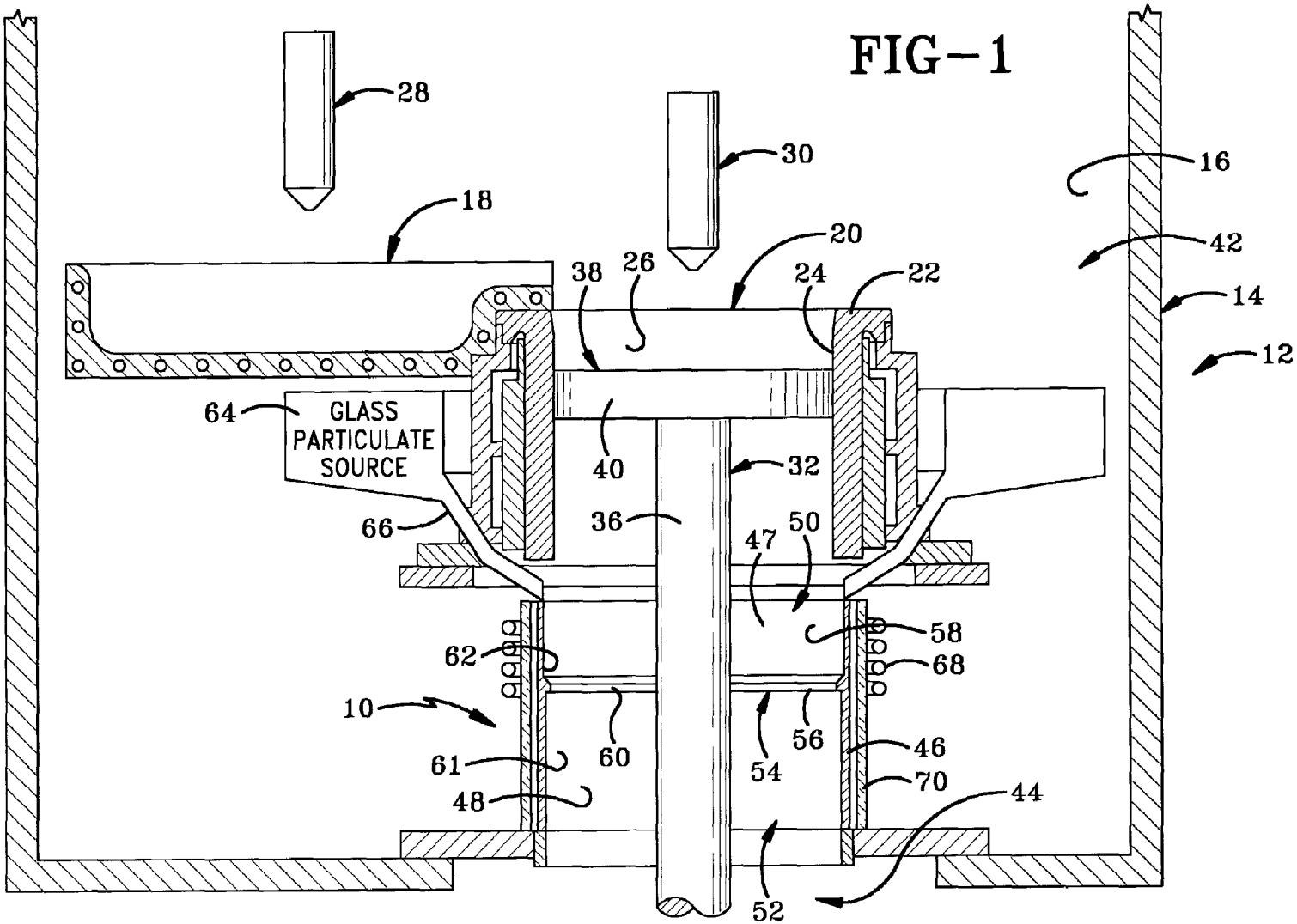
FIG. 1 is a sectional view of the seal of the present invention in use with a continuous casting furnace.

The seal of the present invention is indicated generally at 10 in FIGS. 1-5 in use with a continuous casting furnace 12. Furnace 12 includes a chamber wall 14 which encloses a melting chamber 16 within which seal 10 is disposed. Within melting chamber 16, furnace 12 further includes a melting/refining hearth 18 in fluid communication with a mold 20 having a substantially cylindrical sidewall 22 with a substantially cylindrical inner surface 24 defining a mold cavity 26 therewithin. Heat sources 28 and 30 are disposed respectively above melting/refining hearth 18 and mold 20 for heating and melting reactionary metals such as titanium and superalloys. Heat sources 28 and 30 are preferably plasma torches although other suitable heat sources such as induction and resistance heaters may be used.

Figure 2:
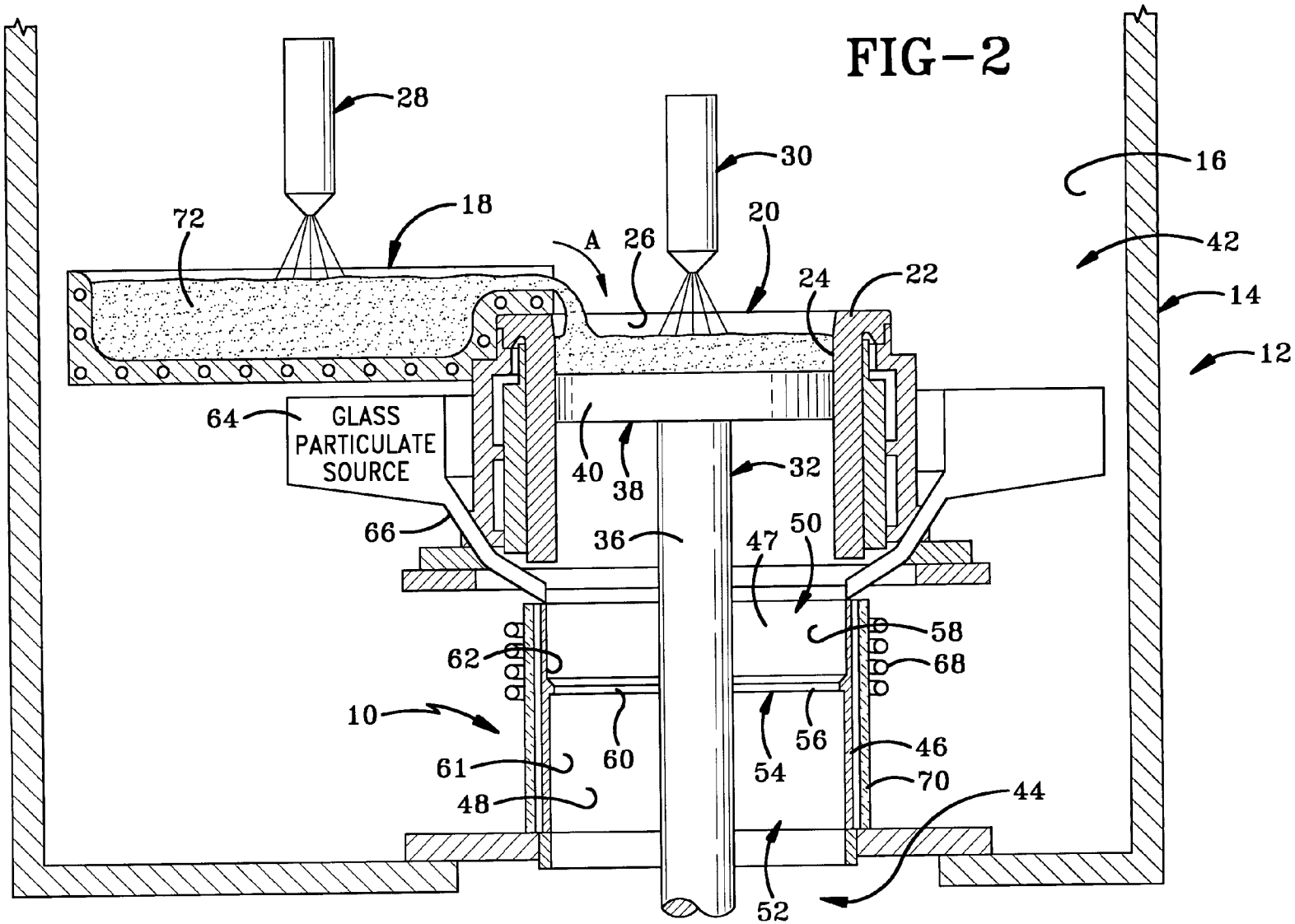
FIG. 2 is similar to FIG. 1 and shows an initial stage of forming an ingot with molten material flowing from the melting/refining hearth into the mold and being heated by heat sources over each of the hearth and mold.
Figure 3:
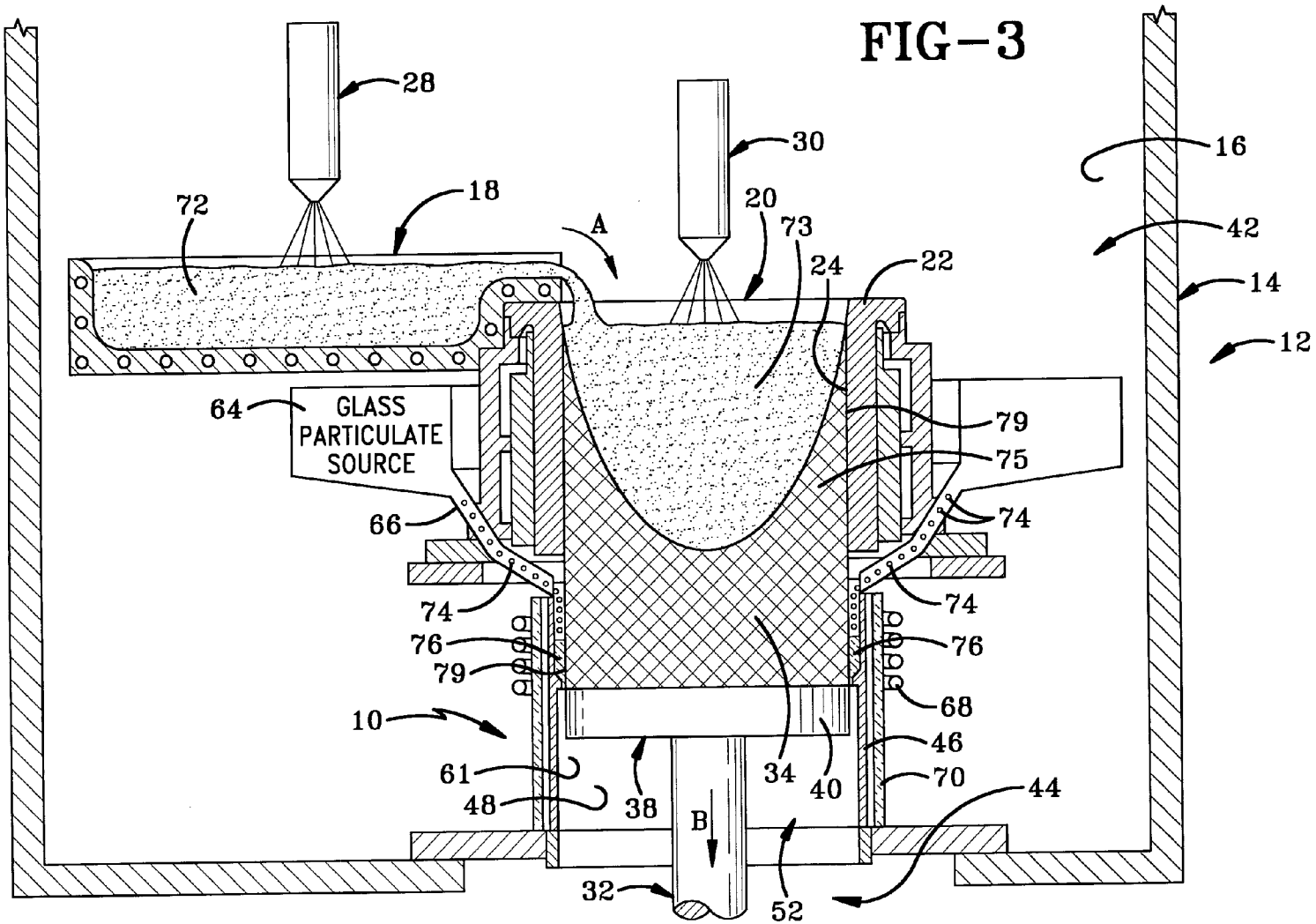
FIG. 3 is similar to FIG. 2 and shows a further stage of formation of the ingot as the ingot is lowered on a lift and into the seal area.
Figure 4:
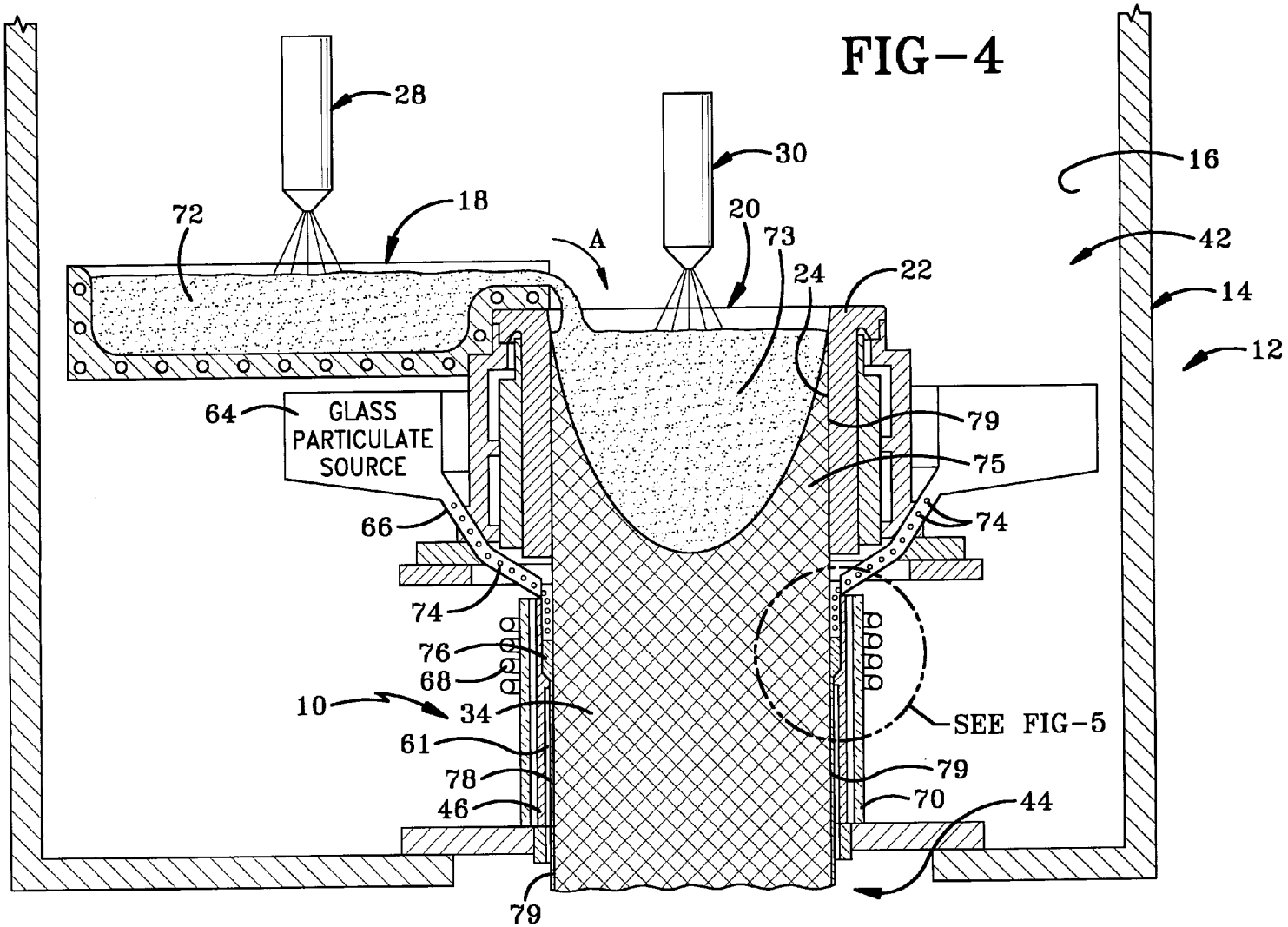
FIG. 4 is similar to FIG. 3 and shows a further stage of formation of the ingot and formation of the glass coating on the ingot.

Furnace 12 further includes a lift or withdrawal ram 32 for lowering a metal cast 34 (FIG. 2-4). Any suitable withdrawal device may be used. Metal cast 34 may be in any suitable form, such as a round ingot, rectangular slab or the like. Ram 32 includes an elongated arm 36 with a mold support 38 in the form of a substantially cylindrical plate seated atop of arm 36. Mold support 38 has a substantially cylindrical outer surface 40 which is disposed closely adjacent inner surface 24 of mold 20 as ram 32 moves in a vertical direction. During operation, melting chamber 16 contains an atmosphere 42 which is non-reactive with reactive metals such as titanium and superalloys which may be melted in furnace 12. Inert gases may be used to form non-reactive atmosphere 42, particularly when using plasma torches, with which helium or argon are often used, most typically the former. Outside of chamber wall 14 is an atmosphere 44 which is reactive with the reactionary metals when in a heated state.

Seal 10 is configured to prevent reactive atmosphere 44 from entering melting chamber 16 during the continuous casting of reactionary metals such s titanium and superalloys. Seal 10 is also configured to protect the heated metal cast 34 when it enters reactive atmosphere 44. Seal 10 includes a passage wall or port wall 46 having a substantially cylindrical inner surface 47 defining passage 48 therewithin which has an entrance opening 50 and an exit opening 52. Port wall 46 includes an inwardly extending annular flange 54 having an inner surface or circumference 56. Inner surface 47 of port wall 46 adjacent entrance opening 50 defines an enlarged or wider section 58 of passage 48 while flange 54 creates a narrowed section 60 of passage 48. Below annular flange 54, inner surface 47 of port wall 46 defines an enlarged exit section 61 of passage 48.

As later explained, a reservoir 62 for a molten material such as liquid glass is formed during operation of furnace 12 in enlarged section 58 of passage 48. A source 64 of particulate glass or other suitable meltable material such as fused salt or slags is in communication with a feed mechanism 66 which is in communication with reservoir 62. Seal 10 may also include a heat source 68 which may include an induction coil, a resistance heater or other suitable source of heat. In addition, insulating material 70 may be placed around seal 10 to help maintain the seal temperature.

The operation of furnace 12 and seal 10 is now described with reference to FIGS. 2-5. FIG. 2 shows heat source 28 being operated to melt reactionary metal 72 within melting/refining hearth 18. Molten metal 72 flows as indicated by Arrow A into mold cavity 26 of mold 20 and is initially kept in a molten state by operation of heat source 30.

FIG. 3 shows ram 32 being withdrawn downwardly as indicated by Arrow B as additional molten metal 72 flows from hearth 18 into mold 20. An upper portion 73 of metal 72 is kept molten by heat source 30 while lower portions 75 of metal 72 begins to cool to form the initial portions of cast 34. Water-cooled wall 22 of mold 20 facilitates solidification of metal 72 to form cast 34 as ram 32 is withdrawn downwardly. At about the time that cast 34 enters narrowed section 60 (FIG. 2) of passage 48, particulate glass 74 is fed from source 64 via feed mechanism 66 into reservoir 62. While cast 34 has cooled sufficiently to solidify in part, it is typically sufficiently hot to melt particulate glass 74 to form liquid glass 76 within reservoir 62 which is bounded by an outer surface 79 of cast 34 and inner surface 47 of port wall 46. If needed, heat source 68 may be operated to provide additional heat through port wall 46 to help melt particulate glass 74 to ensure a sufficient source of liquid glass 76 and/or help keep liquid glass in a molten state. Liquid glass 76 fills the space within reservoir 62 and narrowed portion 60 to create a barrier which prevents external reactive atmosphere 44 from entering melting chamber 16 and reacting with molten metal 72. Annular flange 54 bounds the lower end of reservoir 62 and reduces the gap or clearance between outer surface 79 of cast 34 and inner surface 47 of port wall 46. The narrowing of passage 48 by flange 54 allows liquid glass 76 to pool within reservoir 62 (FIG. 2). The pool of liquid glass 76 in reservoir 62 extends around metal cast 34 in contact with outer surface 79 thereof to form an annular pool which is substantially cylindrical within passage 48. The pool of liquid glass 76 thus forms a liquid seal. After formation of this seal, a bottom door (not shown) which had been separating non-reactive atmosphere 42 from reactive atmosphere 44 may be opened to allow withdrawal of cast 34 from chamber 16.

Figure 5:
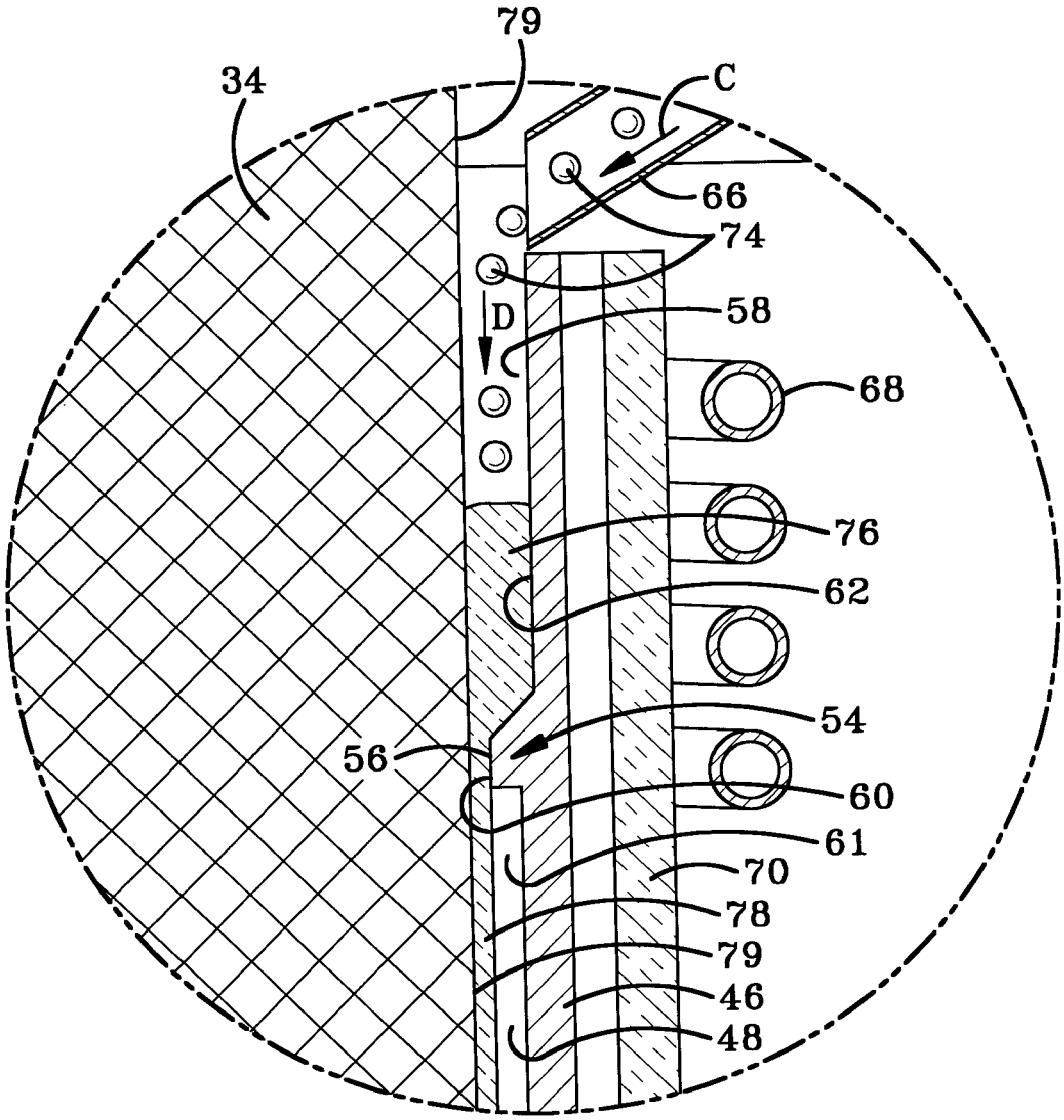
FIG. 5 is an enlarged view of the encircled portion of FIG. 4 and shows particulate glass entering the liquid glass reservoir and the formation of the glass coating.

As cast 34 continues to move downwardly as indicated in FIGS. 4-5, liquid glass 76 coats outer surface 79 of cast 34 as it passes through reservoir 62 and narrowed section 60 of passage 48. Narrowed section 60 reduces the thickness of or thins the layer of liquid glass 76 adjacent outer surface 79 of cast 34 to control the thickness of the layer of glass which exits passage 48 with cast 34. Liquid glass 76 then cools sufficiently to solidify as a solid glass coating 78 on outer surface 79 of cast 34. Glass coating 78 in the liquid and solid states provides a protective barrier to prevent reactive metal 72 forming cast 34 from reacting with reactive atmosphere 44 while cast 34 is still heated to a sufficient temperature to permit such a reaction. Coating 78 also provides an oxidation barrier at lower temperatures.

FIG. 5 more clearly shows particulate glass 74 traveling through feed mechanism 66 as indicated by Arrow C and into enlarged section 58 of passage 48 and into reservoir 62 where particulate glass 74 is melted to form liquid glass 76. FIG. 5 also shows the formation of the liquid glass coating in narrowed section 60 of passage 48 as cast 34 moves downwardly. FIG. 5 also shows an open space between glass coating 78 and port wall 46 within enlarged exit section 61 of passage 48 as cast 34 with coating 78 move through section 61.

Figure 7:
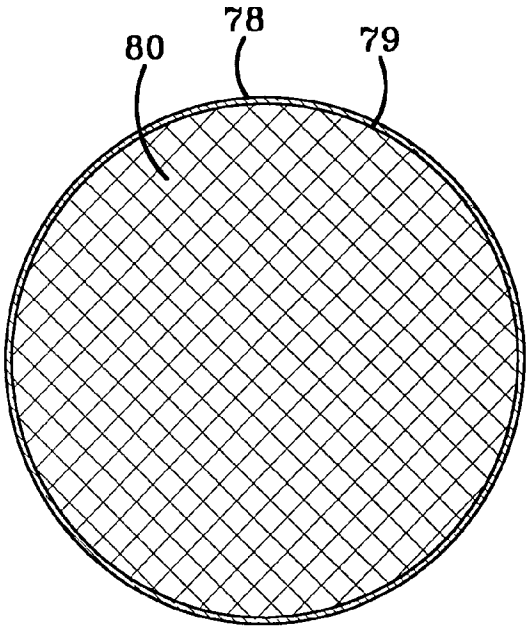
FIG. 7 is a sectional view taken on line 7-7 of FIG. 6.
Figure 6:
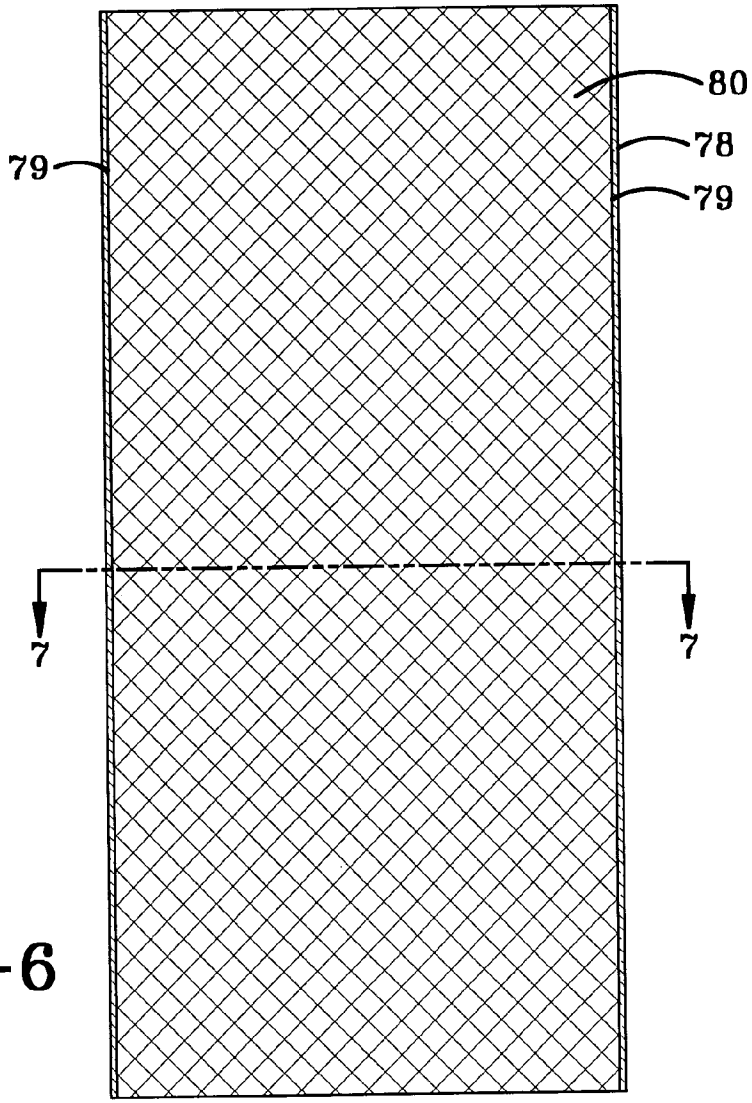
FIG. 6 is a sectional view of the ingot after being removed from the melting chamber of the furnace showing the glass coating on the outer surface of the ingot.

Once cast 34 has exited furnace 12 to a sufficient degree, a portion of cast 34 may be cut off to form an ingot 80 of any desired length, as shown in FIG. 6. As seen in FIGS. 6 and 7, solid glass coating 78 extends along the entire circumference of ingot 80.

Thus, seal 10 provides a mechanism for preventing the entry of reactive atmosphere 44 into melting chamber 16 and also protects cast 34 in the form of an ingot, bar, slab or the like from reactive atmosphere 44 while cast 34 is still heated to a temperature where it is still reactive with atmosphere 44. As previously noted, inner surface 24 of mold 20 is substantially cylindrical in order to produce a substantially cylindrical cast 34. Inner surface 47 of port wall 46 is likewise substantially cylindrical in order to create sufficient space for reservoir 62 and space between cast 34 and inner surface 56 of flange 54 to create the seal and also provide a coating of appropriate thickness on cast 34 as it passes downwardly. Liquid glass 76 is nonetheless able to create a seal with a wide variety of transverse cross-sectional shapes other than cylindrical. The transverse cross-sectional shapes of the inner surface of the mold and the outer surface of the cast are preferably substantially the same as the transverse cross-sectional shape of the inner surface of the port wall, particularly the inner surface of the inwardly extending annular flange in order that the space between the cast and the flange is sufficiently small to allow liquid glass to form in the reservoir and sufficiently enlarged to provide a glass coating thick enough to prevent reaction between the hot cast and the reactive atmosphere outside of the furnace. To form a metal cast suitably sized to move through the passage, the transverse cross-sectional shape of the inner surface of the mold is smaller than that of the inner surface of the port wall.

Additional changes may be made to seal 10 and furnace 12 which are still within the scope of the present invention. For example, furnace 12 may consist of more than a melting chamber such that material 72 is melted in one chamber and transferred to a separate chamber wherein a continuous casting mold is disposed and from which the passage to the external atmosphere is disposed. In addition, passage 48 may be shortened to eliminate or substantially eliminate enlarged exit section 61 thereof. Also, a reservoir for containing the molten glass or other material may be formed externally to passage 48 and be in fluid communication therewith whereby molten material is allowed to flow into a passage similar to passage 48 in order to create the seal to prevent external atmosphere from entering the furnace and to coat the exterior surface of the metal cast as it passes through the passage. In such a case, a feed mechanism would be in communication with this alternate reservoir to allow the solid material to enter the reservoir to be melted therein. Thus, an alternate reservoir may be provided as a melting location for the solid material. However, reservoir 62 of seal 10 is simpler and makes it easier to melt the material using the heat of the metal cast as it passes through the passage.

The seal of the present invention provides increased productivity because a length of the cast can be cut off outside the furnace while the casting process continues uninterrupted. In addition, yield is improved because the portion of each cast that is exposed when cut does not contain shrinkage or pipe cavities and the bottom of the cast does not have a dovetail. In addition, because the furnace is free of a withdrawal chamber, the length of the cast is not limited by such a chamber and thus the cast can have any length that is feasible to produce. Further, by using an appropriate type of glass, the glass coating on the cast may provide lubrication for subsequent extrusion of the cast. Also the glass coating on the cast may provide a barrier when subsequently heating the cast prior to forging to prevent reaction of the cast with oxygen or other atmosphere.

While the preferred embodiment of the seal of the present invention has been described in use with glass particulate matter to form a glass coating, other materials may be used to form the seal and glass coating, such as fused salt or slags for instance.

The present apparatus and process is particularly useful for highly reactive metals such as titanium which is very reactive with atmosphere outside the melting chamber when the reactionary metal is in a molten state. However, the process is suitable for any class of metals, e.g. superalloys, wherein a barrier is needed to keep the external atmosphere out of the melting chamber to prevent exposure of the molten metal to the external atmosphere.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. In combination, a metal cast having an outer periphery and a casting furnace for manufacturing the metal cast, the furnace comprising:

an interior chamber having a sidewall;

a passage wall having an inner periphery which defines a passage extending through the sidewall of the interior chamber for transporting the metal cast from the interior chamber to atmosphere external to the interior chamber; wherein the passage wall includes an inwardly projecting annular flange which bounds a circumferential space within the passage and between the inner periphery of the passage wall and the outer periphery of the metal cast as the metal cast moves through the passage;

a molten bath at least a portion of which is disposed in the circumferential space within the passage to prevent the external atmosphere from entering the interior chamber;

a source of solid coating material; and a heat source for melting the solid coating material at a melting location within the circumferential space to form the molten bath, the heat source including heat radiating from the metal cast; and wherein the furnace is free of a melting chamber for melting the solid coating material at a location external to the interior chamber, wherein the metal cast has a transverse cross-sectional shape; and the passage has a transverse cross-sectional shape substantially the same as and larger than that of the metal cast; and wherein the molten bath is in contact with the metal cast to form a protective barrier thereon as the metal cast moves from the interior chamber to the external atmosphere.

2. The combination of claim 1 wherein the inner periphery of the flange is spaced from and adjacent the outer periphery of the metal cast as it moves through the passage to define a thickness of molten material from the molten bath which is applied to the outer periphery of the metal cast.

3. The combination of claim 1 further including a dispenser for dispensing the solid material into the passage above the annular flange.

4. The combination of claim 1 wherein the furnace is free of a melting chamber external to the passage for melting the solid coating material therein.

5. The combination of claim 1 further comprising a conduit in the interior chamber; and an exit end on the conduit above the molten bath; and wherein the melting location is below and external to the exit end of the conduit; and the coating material is movable in a solid state from the source through the conduit and out of the exit end to the melting location.

* * * * *